US009738470B2

(12) United States Patent
Tagashira

(10) Patent No.: US 9,738,470 B2
(45) Date of Patent: Aug. 22, 2017

(54) PAPER TRANSFER DEVICE

(71) Applicant: RISO KAGAKU CORPORATION, Tokyo (JP)

(72) Inventor: Shinya Tagashira, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/088,360

(22) Filed: Apr. 1, 2016

(65) Prior Publication Data

US 2016/0347567 A1 Dec. 1, 2016

(30) Foreign Application Priority Data

May 25, 2015 (JP) ..... 2015-105476

(51) Int. Cl.
*B65H 5/06* (2006.01)

(52) U.S. Cl.
CPC ..... *B65H 5/062* (2013.01); *B65H 2403/5331* (2013.01); *B65H 2404/1341* (2013.01); *B65H 2404/142* (2013.01); *B65H 2404/143* (2013.01); *B65H 2404/144* (2013.01); *B65H 2404/1442* (2013.01); *B65H 2404/1523* (2013.01); *B65H 2404/611* (2013.01); *B65H 2601/11* (2013.01); *B65H 2601/255* (2013.01)

(58) Field of Classification Search
CPC ..... B65H 5/062; B65H 2404/142; B65H 2404/144; B65H 2404/1442; B65H 2601/255
USPC ..... 271/273, 274
See application file for complete search history.

(56) References Cited

U.S. PATENT DOCUMENTS 6,145,828 A * 11/2000 Arai ..... G03G 15/231 271/186
6,799,008 B1 * 9/2004 Lim ..... G03G 15/6573 271/264
7,306,221 B2 * 12/2007 Agata ..... B65H 5/062 271/250
7,950,659 B2 * 5/2011 Matsushima ..... B65H 29/125 271/264
8,083,231 B2 * 12/2011 Hirata ..... B65H 5/38 271/273
9,604,807 B2 * 3/2017 Etsuki ..... B65H 5/062
2015/0084266 A1 3/2015 Tsumura et al.

FOREIGN PATENT DOCUMENTS

JP 2015063381 4/2015

* cited by examiner

*Primary Examiner* — Jeremy R Severson
(74) *Attorney, Agent, or Firm* — Hamre, Schumann, Mueller & Larson, P.C.

(57) ABSTRACT

A paper transfer includes a first paper guide plate, a second paper guide plate, and a draw-out guide member. The first paper guide plate has a transfer roller for transferring a paper while guiding one face of the paper. The second paper guide plate that can be drawn out while facing to the first paper guide plate, and has a driven roller driven while pressing the transfer roller with the paper interposed therebetween to guide another face of the paper. The draw-out guide member is formed so as to release a nip between the transfer roller and the driven roller by separating the driven roller from the transfer roller when the first paper guide plate is drawn out in an engaged state where the draw-out member is engaged with an engagement portion provided on the second paper guide plate.

1 Claim, 11 Drawing Sheets

FIG. 10 -- PRIOR ART
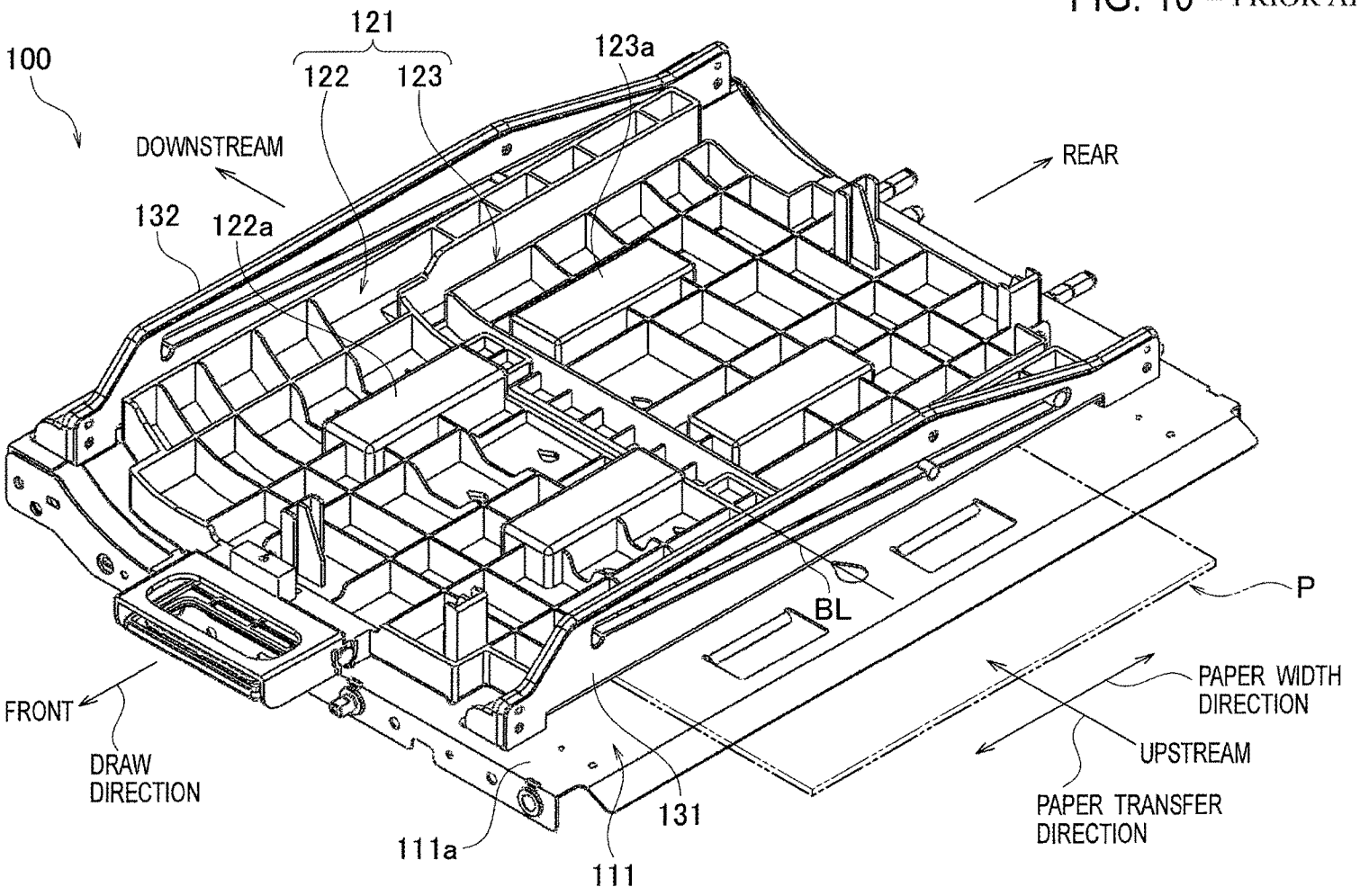

FIG. 11 -- PRIOR ART
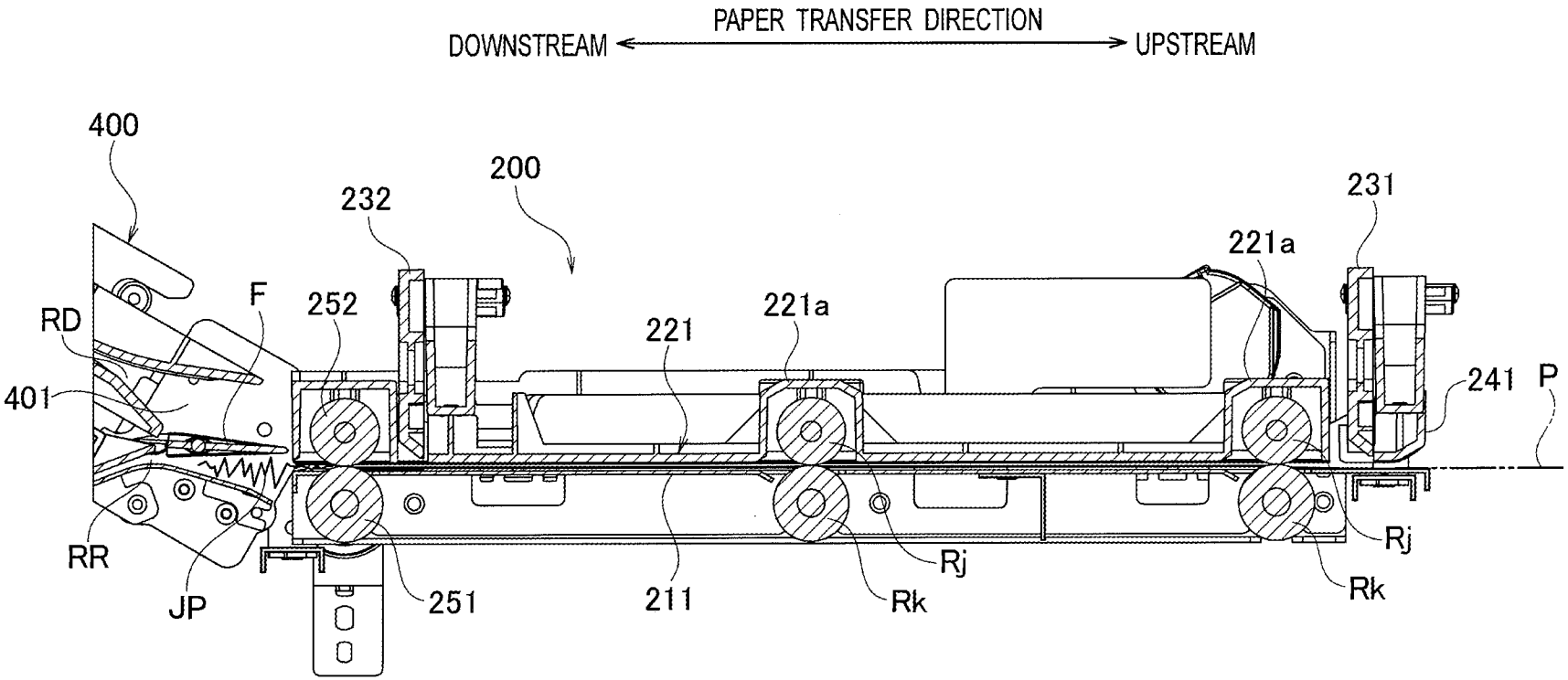

PAPER TRANSFER DEVICE

BACKGROUND OF THE INVENTION

Technical Field

The present invention relates to a paper transfer device.

Background Arts

Generally, a paper transfer device for transferring papers along a paper transfer path is applied to a printer that prints images and/or texts on a paper, or to an image forming apparatus such as a copier that copies images and/or texts on a paper.

A Patent Document 1 (Japanese patent application publication No. 2015-63381) discloses an example of this kind of a paper transfer device. According to the paper transfer device disclosed in the Patent Document 1, it is possible to remove a paper jammed between two neighboring paper transfer devices without remaining a piece of the jammed paper.

Hereinafter, the paper transfer device disclosed in the Patent Document 1 will be explained briefly with reference to FIG. 10.

As shown in FIG. 10, the prior-art paper transfer device 100 disclosed in the Patent Document 1 is mounted along a paper transfer path in an inkjet printer (image forming apparatus). The paper transfer device 100 is disposed between neighboring two devices (not shown in FIG. 10) that are disposed adjoiningly on upstream and downstream sides of the paper transfer device 100 along the paper transfer direction, respectively.

In the paper transfer device 100, a drive-side paper guide plate 111 and a driven-side paper guide plate 121 are provided so as to face to each other. Plural drive rollers (not shown in FIG. 10) are attached to the drive-side paper guide plate 111. Plural driven rollers (not shown in FIG. 10) driven by the drive rollers are attached to box-shaped portions 122*a* and 123*a* of the driven-side paper guide plate 121. A paper P is transferred between the drive-side paper guide plate 111 and the driven-side paper guide plate 121, i.e. transferred by the drive rollers and the driven rollers while being nipped therebetween.

The drive-side paper guide plate 111 is fixedly disposed beneath the paper transfer path. An upstream-side portion of the drive-side paper guide plate 111 in the paper transfer direction is made flat, and a downstream side thereof is curved upward so as to lead a paper to a paper transfer path extending in a downstream one of the neighboring two devices.

The driven-side paper guide plate 121 is disposed above the paper transfer path so as to face to the drive-side paper guide plate 111. The driven-side paper guide plate 121 is divided, along a paper width direction perpendicular to the paper transfer direction, into a first divided paper guide plate 122 and a second divided paper guide plate 123 by a dividing line BL. The first divided paper guide plate 122 can be drawn out to one side along the paper width direction (to a front side of the device 100). The second divided paper guide plate 123 can be opened upwardly (is rotatable) while keeping its location on the other side along the paper width direction (on a rear side of the device 100).

The first divided paper guide plate 122 is slidably attached to the drive-side paper guide plate 111 so that it can be drawn to the front side while being guided by a pair of draw-out guide plates 131 and 132 that are attached to an upper surface 111*a* of the drive-side paper guide plate 111. When the first divided paper guide plate 122 is drawn out, nips between the drive rollers and the driven rollers are released.

According to the above paper transfer device 100, a paper is transferred from upstream to downstream along the paper transfer direction between the drive-side paper guide plate 111 and the driven-side paper guide plate 121 while being nipped and fed-forward by the drive rollers and the driven rollers. Even in a case where a paper jams between the drive-side paper guide plate 111 and the driven-side paper guide plate 121 and the jammed paper extends across the dividing line BL (extends from one of the neighboring two devices to the paper transfer device 100), a user can easily remove the jammed paper by hand without remaining a piece of the jammed paper in the paper transfer device 100, because nips between the drive rollers and the driven rollers are released by drawing out the first divided paper guide plate 122 to the front side.

SUMMARY OF THE INVENTION

Next, an imaginary paper transfer device 200 that might be made by applying the above mechanism disclosed in the Patent Document 1 to an image forming apparatus as it is will be explained briefly with reference to FIG. 11.

As shown in FIG. 11, the paper transfer device 200 is disposed between neighboring two devices that are located upstream and downstream sides of the paper transfer device 200 in a paper transfer direction, respectively. One of the neighboring two devices that is disposed on the downstream side is another paper transfer device 400.

A swingable flap F that changes the paper transfer direction of a paper P is provided on a paper transfer path 401 in the other paper transfer device 400. The paper transfer path 401 can be changed over selectively by the flap F so as to lead a paper P to an ejection path RD or a turn-over path RR.

In the paper transfer device 200, a drive-side paper guide plate 211 and a driven-side paper guide plate 221 are provided so as to face to each other. Plural drive rollers Rk are attached to the drive-side paper guide plate 211 at intervals along the paper transfer direction. Plural driven rollers Rj driven by the drive rollers Rk are attached to plural box-shaped portions 221*a* of the driven-side paper guide plate 221. A paper P is transferred between the drive-side paper guide plate 211 and the driven-side paper guide plate 221, i.e. transferred by the drive rollers Rk and the driven rollers Rj while being nipped therebetween.

The drive-side paper guide plate 211 is made flat from upstream to downstream in the paper transfer direction. The driven-side paper guide plate 221 can be drawn out to a front side of the paper transfer device 200 in a paper width direction perpendicular to the paper transfer direction (in a vertical direction to a plane of FIG. 11). When the driven-side paper guide plate 221 is drawn out, nips between the drive rollers Rk and the driven rollers Rj are released. A pair of draw-out guide plates 231 and 232 that guide drawing-out of the driven-side paper guide plate 221 is attached to the drive-side paper guide plate 211 at upstream-side and downstream-side portions of the drive-side paper guide plate 211 so as to be distanced from each other along the paper transfer direction and to be almost parallel to the paper width direction.

In addition, a paper restriction member 241 is fixedly provided on an upstream side of the upstream-side draw-out guide plate 231 so as to form a minute gap between the paper restriction member 241 and the drive-side paper guide plate 211. The paper restriction member 241 is a transfer relay member for guiding relay-transfer of a paper P between the paper transfer device 200 and an upstream one of the neighboring two devices. According to this configuration, the paper transfer device 200 can introduce a paper thereinto from the upstream one of the neighboring two devices.

Further, a drive relay roller 251 and a driven relay roller 252 are fixedly provided in a pair on a downstream side of the downstream-side draw-out guide plate 232. The pair of relay rollers 251 and 252 is a transfer relay member for guiding relay-transfer of a paper P between the paper transfer device 200 and the other paper transfer device 400, and is always in a nipped state. According to this configuration, the paper transfer device 200 can send a paper P passing through the pair of relay rollers 251 and 252 to the paper transfer path 401 in the other paper transfer device 400.

Therefore, a center portion of the driven-side paper guide plate 221 between the pair of draw-out guide plates 231 and 232 can be drawn out to the front side. The upstream-side portion of the driven-side paper guide plate 221 that has the paper restriction member 241 and the downstream-side portion of the driven-side paper guide plate 221 that has the driven relay roller 252 are provided independently from the center portion of the driven-side paper guide plate 221, so that the upstream-side and downstream-side portions of the driven-side paper guide plate 221 cannot be drawn out (not slidable but fixed).

According to the paper transfer device 200, a jammed paper JP in the paper transfer device 200 can be removed by drawing out the driven-side paper guide plate 221 to the front side. However, relaying of a paper P is guided at the upstream-side and downstream-side portions of the driven-side paper guide plate 221, so that a jammed paper JP jammed between the paper transfer device 200 and any one of the neighboring two devices may become hard to be removed. A jammed paper JP jammed between the paper transfer device 200 and the other paper transfer device 400 (the downstream one of the neighboring two devices) is shown in FIG. 11.

The paper restriction member 241 is provided on the upstream-side portion of the drive-side paper guide plate 211 that has the upstream-side draw-out guide plate 231. The driven relay roller 252 is provided on the downstream-side portion of the drive-side paper guide plate 211 that has the downstream-side draw-out guide plate 232. Therefore, nips of a jammed paper JP extending through the paper restriction member 241 or the driven relay roller 252 are not released when the driven-side paper guide plate 221 is drawn out to the front side. Therefore, the jammed paper JP extending between the paper transfer device 200 and any one of the neighboring two devices may become hard to be removed.

In order to make it possible to release a nip of a jammed paper JP by the pair of relay rollers 251 and 252 upon drawing out the driven-side paper guide plate 221, the downstream-side draw-out guide plate 232 must be disposed further downstream from the pair of relay rollers 251 and 252. Similarly, in order to make it possible to release a nip of a jammed paper JP by the paper restriction member 241 (and an upper surface of the upstream-side portion of the drive-side paper guide plate 211) upon drawing out the driven-side paper guide plate 221, the upstream-side draw-out guide plate 231 must be disposed further upstream from the paper restriction member 241. Therefore, a size of the paper transfer device 200 must become large along the paper transfer direction.

An object of the present invention is to provide a paper transfer device that makes it possible to remove a jammed paper extending from the paper transfer device to a neighboring device easily and surely without making its size along a paper transfer direction large.

An aspect of the present invention provides a paper transfer device that transfers a paper along a paper transfer path, the device comprising: a first paper guide plate that includes a transfer roller for transferring the paper in the a paper transfer direction to guide one face of the paper while transferring the paper; a second paper guide plate that can be drawn out in a draw-out direction perpendicular to the paper transfer direction while facing to the first paper guide plate, and includes a driven roller driven while pressing the transfer roller with the paper interposed therebetween to guide another face of the paper while transferring the paper; and a draw-out guide member that is provided above the second paper guide plate, and formed so as to release a nip between the transfer roller and the driven roller by separating the driven roller from the transfer roller when the first paper guide plate is drawn out in the draw-out direction in an engaged state where the draw-out member is engaged with an engagement portion provided on the second paper guide plate.

BRIEF DESCRIPTION OF THE DRAWINGS

FIG. 10 is a perspective view of a prior-art paper transfer device; and

FIG. 11 is a cross-sectional front view of an imaginary paper transfer device to which mechanism of the prior-art paper transfer device might be applied.

DESCRIPTION OF THE EMBODIMENTS

Hereinafter, a paper transfer device 30 according to an embodiment will be described with reference to FIG. 1 to FIG. 9.

The paper transfer device 30 according to the present embodiment is applied to an image forming apparatus 10 that prints images and/or texts on a paper, or to an image forming apparatus 10 such as a copier that copies images and/or texts on a paper. The paper transfer device 30 is unitized as a unit, and disposed on a paper transfer path 12 along which a paper P is transferred in the image forming apparatus 10.

Note that terms "upstream" and "downstream" are used with respect to a paper transfer direction in following descriptions.

First, the image forming apparatus (inkjet printer) 10 to which the paper transfer device 30 is applied will be described with reference to FIG. 1.

(Inkjet Printer)

Figure 1:
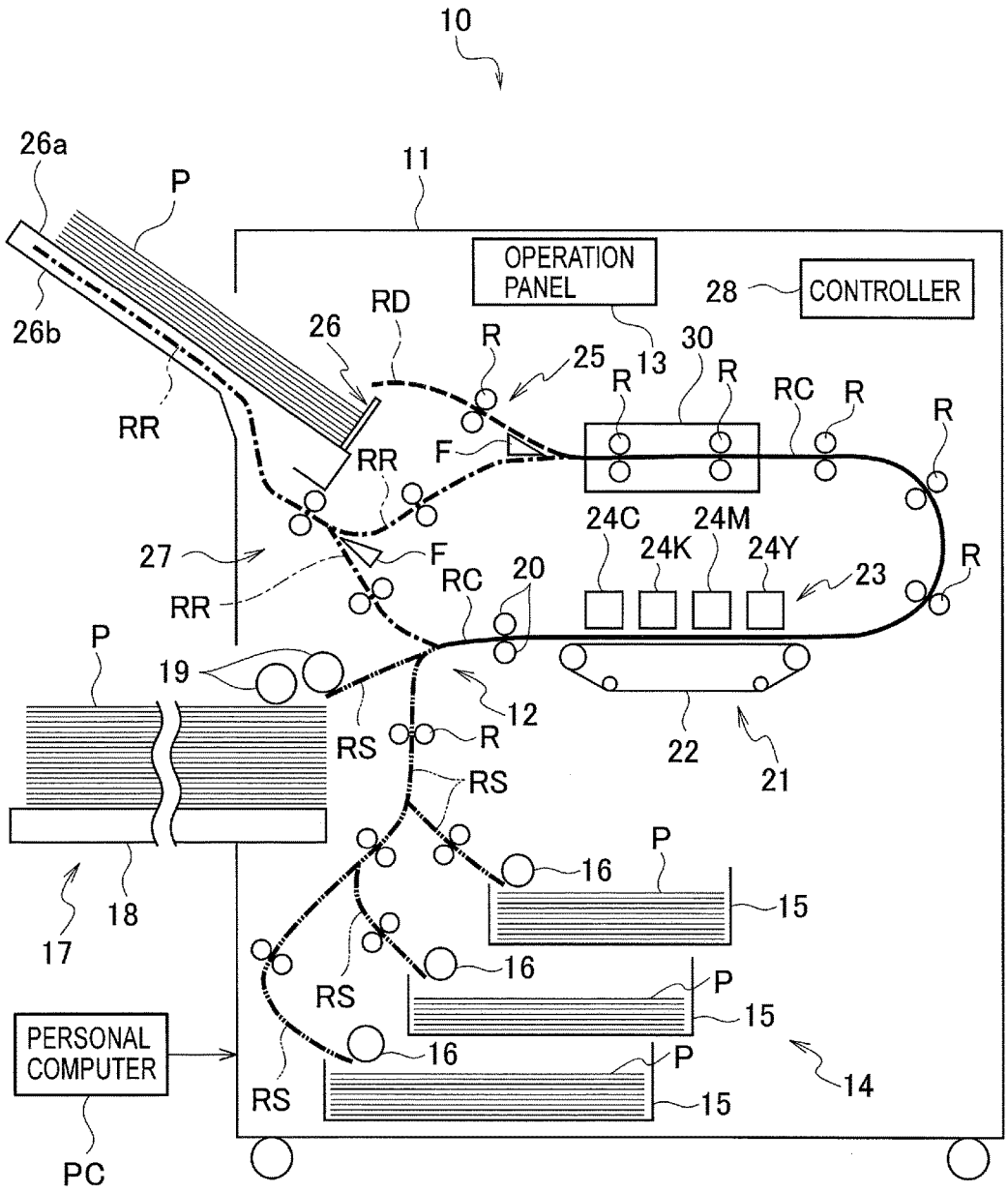
FIG. 1 is a configurational diagram of an inkjet printer provided with a paper transfer device according to an embodiment.

As shown in FIG. 1, the inkjet printer 10 to which the paper transfer device 30 (see FIG. 2) is applied performs single-side printing or double-side (duplex) printing on a paper P based on image data input from a personal computer PC.

The inkjet printer 10 includes the paper transfer path 12, an operation panel 13, an internal paper feeder 14, an external paper feeder 17, a belt platen portion 21, an inkjet print unit 23, a paper ejector 25, a paper turn-over portion 27, a controller 28, and the paper transfer device 30, in its housing 11 formed to have a box-shape.

The paper transfer path 12 is branched into plural paths in the housing 11 in order to transfer a paper P for single-side printing or double-side (duplex) printing. The paper transfer path 12 includes paper feed paths RS indicated by dashed two-dotted lines, a normal path RC indicated by a solid line, a paper ejection path RD indicated by a dashed line, and switchback paths RR indicated by dashed one-dotted lines. The switchback paths RR are used for turning over a paper P during double-side printing.

A loop path is formed by the normal path RC and the switchback paths RR. The paper feed path RS is connected to the loop path, and part of the loop path is extended along the inkjet print unit 23. Plural pairs of paper transfer rollers R for transferring a paper(s) P and plural flaps F for changing over transfer directions of a paper(s) P are disposed at their proper positions on the paper transfer path 12.

The operation panel 13 is provided at an upper portion of the housing 11. The operation panel 13 is provided with various buttons, a numeric keypad, a display screen and so on that are used for printing a print job(s).

The internal paper feeder 14 includes plural internal paper feed trays 15 disposed at a lower left portion in the housing 11. The internal paper feed trays 15 are formed according to paper sizes of papers P, and aligned vertically. Each of the internal paper feed trays 15 can be drawn out to the front side (your side with respect to FIG. 1) of the inkjet printer 10. Papers P are stacked on each of the internal paper feed trays 15. It is possible to detect a paper size of papers P staked on each of the internal paper feed trays 15.

One of the internal paper feed trays 15 (a paper size) is selected by a user's operation input to the operation panel 13, and an uppermost paper P among papers P stacked on the selected internal paper feed tray 15 is fed out, sheet by sheet, by an internal paper feed roller 16. Then, a paper P fed out from the selected internal paper feed tray 15 is transferred from the paper feed path RS to the normal path RC at a constant transfer speed, and an oblique transfer of the paper P is compensated by a pair of registration rollers 20 provided at an upstream part of the normal path RC.

The external paper feeder 17 includes an external paper feed tray 18 disposed at a left side portion of the housing 11 so that part of the external paper feed tray 18 is exposed to the outside. Papers P all having the same paper size are stacked on the external paper feed tray 18. It is also possible to detect a paper size of papers P staked on the external paper feed tray 18.

An uppermost paper P among papers P stacked on the external paper feed tray 18 is fed out, sheet by sheet, by external paper feed rollers 19. Then, a paper P fed out from the external paper feed tray 18 is transferred from the paper feed path RS to the normal path RC at a constant transfer speed, and an oblique transfer of the paper P is compensated by the pair of registration rollers 20 provided at an upstream part of the normal path RC.

The belt platen portion 21 and the inkjet print unit 23 are disposed at almost the center in the housing 11 so as to face with each other with the normal path RC interposed therebetween. The inkjet print unit 23 is disposed above the belt platen portion 21. At the belt platen portion 21, a paper P from the pair of registration roller 20 is sent to a downstream part of the normal path RC at a constant transfer speed while being air-suctioned onto a circularly-runnable endless belt platen 22.

The inkjet print unit 23 prints a multicolor image on a paper P laid on the endless belt platen 22 based on image information by using line-type inkjet heads 24C, 24K, 24M and 24Y that inject droplets of cyan (C) ink, black (K) ink, magenta (M) ink and yellow (Y) ink, respectively.

The paper ejector 25 is disposed at an upper portion of the left side portion of the housing 11, and includes a paper ejection tray 26. The paper ejection tray 26 is located at the most downstream end of the paper ejection path RD. Papers P printed by the inkjet print unit 23 are sequentially stacked on an upper surface of the paper ejection tray 26.

The paper turn-over portion 27 is also disposed at the upper portion of the left side portion of the housing 11. In the paper turn-over portion 27, a paper P on whose one side images have already been printed is transferred through the loop-shaped normal path RC and then introduced to the switchback path RR. The paper P is temporarily held at a switchback guide 26*b* provided on a back-surface side of the paper ejection tray 26. Subsequently, the paper P is draw out from the switchback paths RR with its leading edge is exchanged, and then the paper P is turned over by the loop-shaped path(s). The turned-over paper P is transferred to the inkjet print unit 23 again through the pair of registration rollers 20, and then images are printed on another side of the paper P by the inkjet print unit 23. In this manner, double-side (duplex) printing is done.

The controller 28 is disposed at a proper location in the housing 11. The controller 28 includes a ROM, a RAM, a counter, a timer and so on therein. The controller 28 totally controls the inkjet printer 10, and also controls the paper transfer device 30.

The paper transfer device 30 is provided to have plural pairs of paper transfer rollers R on the normal path RC that is formed to have a loop-shape in the paper transfer path 12. The paper transfer device 30 is unitized as a unit, and disposed at an upstream side from a divergent point where the normal path RC divaricates to the paper ejection path RR and the switchback path RR.

Along with the paper transfer device 30, a neighboring paper transfer unit (not shown in the drawings) is disposed adjoiningly on an upstream side of the paper transfer device 30. On the other hand, another neighboring paper transfer unit 300 (not shown in FIG. 1: see FIG. 9) is disposed adjoiningly on a downstream side of the paper transfer device 30. The other neighboring paper transfer device 300 includes a flap F for selectively leading a paper P to the paper ejection path RD or the switchback path RR.

The paper transfer device 30 is configured so that a jammed paper JP extending from the paper transfer device 30 to the downstream-side other neighboring paper transfer device (or a jammed paper extending from the upstream-side neighboring paper transfer device to the paper transfer device 30) can be removed easily and surely without remaining a piece of the jammed paper JP.

Hereinafter, the paper transfer device 30 will be described in detail.

(Paper Transfer Device)

Figure 2:
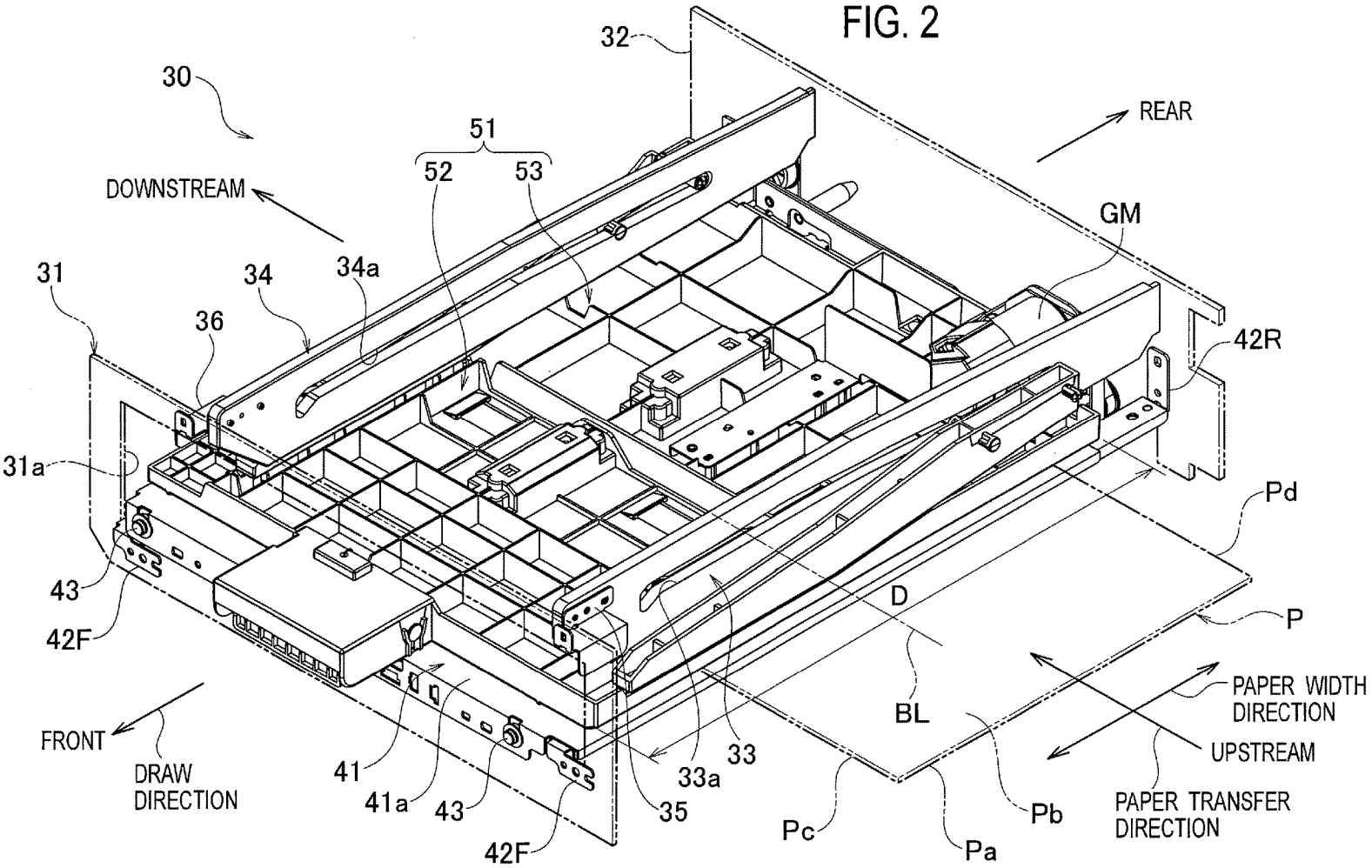
FIG. 2 is a perspective view of the paper transfer device.
Figure 3:
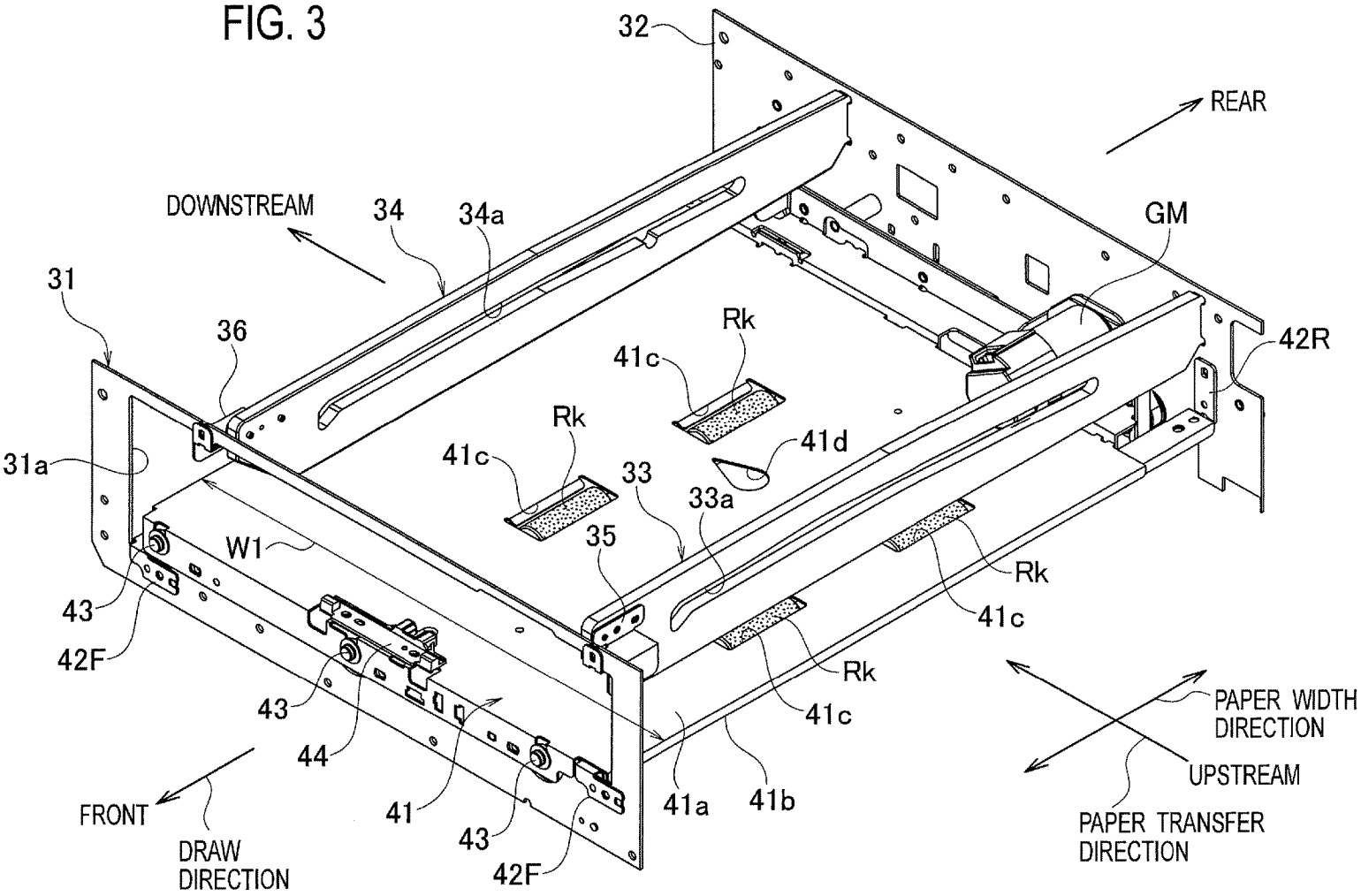
FIG. 3 is a perspective view of a drive-side paper guide plate in the paper transfer device.

As shown in FIG. 2 and FIG. 3, the paper transfer device 30 is provided with a front panel 31 and a rear panel 32. The front panel 31 and the rear panel 32 are raised vertically at a front end and a rear end of the paper transfer device 30, respectively, so as to extend almost parallel to the paper transfer direction. The front panel 31 and the rear panel 32 are distanced from each other along a paper width direction perpendicular to the paper transfer direction, and face to each other.

A first paper guide plate (hereinafter, referred as a drive-side paper guide plate) 41 is attached to lower portions of the front panel 31 and the rear panel 32, by use of screws, via brackets 42F and 42R. Plural transfer rollers (hereinafter, referred as drive rollers) Rk for transferring a paper P are attached to the drive-side paper guide plate 41. The brackets 42F are attached to both sides of a front end of the drive-side paper guide plate 41. The brackets 42R are attached to both sides of a rear end of the drive-side paper guide plate 41 (only one of them is shown in FIG. 2 and FIG. 3). Therefore, the drive-side paper guide plate 41 is fixedly supported by the front panel 31 and the rear panel 32 at its front and rear ends.

As shown in FIG. 3, the drive-side paper guide plate 41 is formed from a metal plate material so as to have a lateral width W1 along the paper transfer direction. A width of the drive-side paper guide plate 41 along the paper width direction is made wider than a width of a largest-size paper P. An almost-rectangular upper surface 41*a* of the drive-side paper guide plate 41 is formed flat. Front, rear, left and right edges of the drive-side paper guide plate 41 are bent downward to enhance rigidity thereof.

The drive-side paper guide plate 41 is disposed along the normal path RC shown in FIG. 1 and beneath the normal path RC to guide one face (a bottom face) of a paper P. In addition, three drive shafts 43 are provided almost parallel to the paper width direction on a side of a bottom surface 41*b* of the drive-side paper guide plate 41. The drive shafts 43 are provided at an upstream portion, an almost center portion and a downstream portion of the drive-side paper guide plate 41 along the paper width direction so as to be distanced from each other.

Two drive rollers Rk are fixedly attached to each of the drive shafts 43 so as to be distanced from each other along the paper width direction. Each of the drive rollers Rk is slightly protruded from the bottom surface 41*b* to the upper surface 41*a* in a roller exposure hole 41*c* formed on the drive-side paper guide plate 41. In addition, the drive shafts 43 are coupled with a geared motor GM via a transmission mechanism (not shown in the drawings) provided on a rear side portion of the drive-side paper guide plate 41 so that they can be rotated by the geared motor GM.

Note that plural types of a paper P having different sizes are transferred on the drive-side paper guide plate 41 with being centered with respect to a transfer virtual centerline for transferring a paper P while positions of its side edges Pc and Pd are not restricted. A lock mechanism 44 is provided at an almost center of the front end of the drive-side paper guide plate 41. The lock mechanism 44 locks a first divided paper guide plate 52 of a driven-side paper guide plate 51 that will be described later. A finger hole 41*d* is formed at an almost center of the drive-side paper guide plate 41. The finger hole 41*d* functions as an escape hole that will be used when pinching an edge of a jammed paper laid on the drive-side paper guide plate 41.

As shown in FIG. 2, a second paper guide plate (hereinafter, referred as a driven-side paper guide plate) 51 is provided above the drive-side paper guide plate (the first paper guide plate) 41. Plural driven rollers Rj (see FIG. 6B) that are passively rotated by the drive rollers Rk are attached to the driven-side paper guide plate 51. The driven-side paper guide plate 51 faces to the drive-side paper guide plate 41. The driven-side paper guide plate 51 is disposed along the normal path RC shown in FIG. 1 and above the normal path RC to guide another face (an upper face) of a paper P.

The driven-side paper guide plate 51 is configured of a first divided paper guide plate 52 and a second divided paper guide plate 53 that are divided along the paper width direction. A dividing line BL, extending in the paper transfer direction, of the first divided paper guide plate 52 and the second divided paper guide plate 53 is disposed at an almost center in the paper width direction. A position of the dividing line BL with respect to a length D (see FIG. 2) of the paper transfer device 30 along the paper width direction is set at a position of almost D/2.

The first divided paper guide plate 52 can be drawn out in a draw-out direction, i.e. to one side along the paper width direction (to the front side of the paper transfer device 30). The second divided paper guide plate 53 can be opened upwardly (is rotatable) on a rear side of the first divided paper guide plate 52 while keeping its location on another side along the paper width direction (on the rear side of the paper transfer device 30).

A pair of draw-out guide member (hereinafter, referred as a pair of draw-out guide plates) 33 and 34 for guiding a draw-out operation of the first divided paper guide plate 52 to the front side is provided above the first divided paper guide plate 52. The pair of draw-out guide plates 33 and 34 is distanced from the drive-side paper guide plate 41, and also distanced from the first divided paper guide plate 52.

The draw-out guide plates 33 and 34 are disposed at an upstream inner side and a downstream inner side with respect to the lateral width W1 (see FIG. 3) of the drive-side paper guide plate 41 so as to be almost parallel to the paper width direction and to be distanced from each other. Front and rear ends of the upstream-side draw-out guide plate 33 are fixedly supported by the front panel 31 and the rear panel 32, respectively. Similarly, front and rear ends of the downstream-side draw-out guide plate 34 are fixedly supported by the front panel 31 and the rear panel 32, respectively. A guide slot 33*a* for guiding a draw-out operation of the first divided paper guide plate 52 is formed on the draw-out guide plate 33 longitudinally along the paper width direction. Similarly, a guide slot 34*a* for guiding a draw-out operation of the first divided paper guide plate 52 is formed on the draw-out guide plate 34 longitudinally along the paper width direction.

Front-side portions of the guide slots 33*a* and 34*a* are formed almost parallel to each other, and located higher than the upper surface 41*a* of the drive-side paper guide plate 41. Rear-side portions of the guide slots 33*a* and 34*a* are formed almost parallel to each other, and located higher than the upper surface 41*a* of the drive-side paper guide plate 41 but lower than the front-side portions. Middle portions of the guide slots 33*a* and 34*a* are formed almost parallel to each other, and are sloped gradually made lower from the front-side portions to the rear-side portions.

The guide slot 33*a* is engaged with pins 54 and 55 (see FIG. 6A) formed on an after-described upstream-side guide wing portion 52*h* of the first divided paper guide plate 52. Similarly, the guide slot 34*a* is engaged with pins 54 and 55 (see FIG. 6A) formed on an after-described downstream-side guide wing portion 52*i* of the first divided paper guide plate 52. Therefore, a draw-out operation of the first divided paper guide plate 52 is guided by the guide slots 33*a* and 34*a*. Since the front-side portions of the guide slots 33*a* and 34*a* are made higher, nips between the drive rollers Rk and the driven rollers Rj are released along with the draw-out operation of the first divided paper guide plate 52. The pins 54 and 55 function as engagement portions that engage with the guide slots 33*a* and 34*a*.

Front ends of the draw-out guide plates 33 and 34 are fixedly attached, by use of screws, to an upper portion of the front panel 31 via brackets 35 and 36 formed at the front ends, respectively. Rear ends of the draw-out guide plates 33 and 34 are inserted into support holes (not shown in the drawings) formed on the rear panel 32, and thereby fixedly supported by the rear panel 32, respectively. The first divided paper guide plate 52 can be slid through a rectangular hole 31*a* widely opened on the front panel 31 while being guided by the pair of draw-out guide plates 33 and 34.

Since a space above the driven-side paper guide plate 51 is opened upward between the front panel 31 and the rear panel 32, a user can insert his/her hand into the paper transfer device 30 over the front panel 31. Therefore, a jammed paper laid on the drive-side paper guide plate 41 can be removed easily and surely by hand when the first divided paper guide plate 52 of the driven-side paper guide plate 51 is drawn out to the front side.

Since the pair of draw-out guide plates 33 and 34 is not attached onto the upper surface 41*a* of the drive-side paper guide plate 41, an after-described transfer relay member(s) for relaying a paper P between the paper transfer device 30 and any one of the neighboring two paper transfer devices can be provided on the first divided paper guide plate 52 so as to be drawn out together with the first divided paper guide plate 52. Namely, it is not needed to dispose a transfer relay member (such as the paper restriction member 241 and the driven relay roller 252 in the imaginary paper transfer device 200 that has been described above with reference to the FIG. 11) fixedly along the paper transfer direction.

Figure 4:
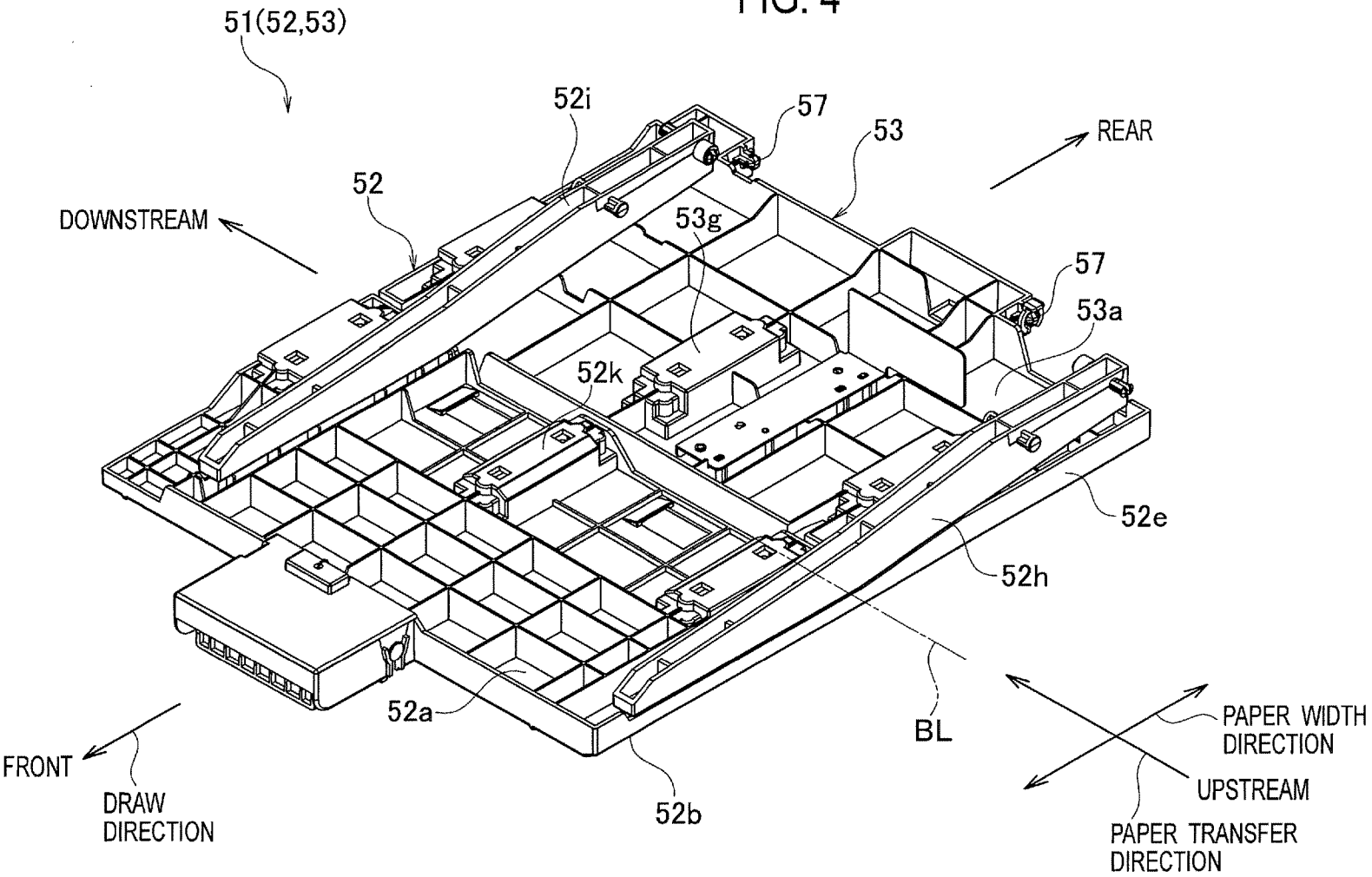
FIG. 4 is a perspective view of a driven-side paper guide plate in the paper transfer device.
Figure 5:
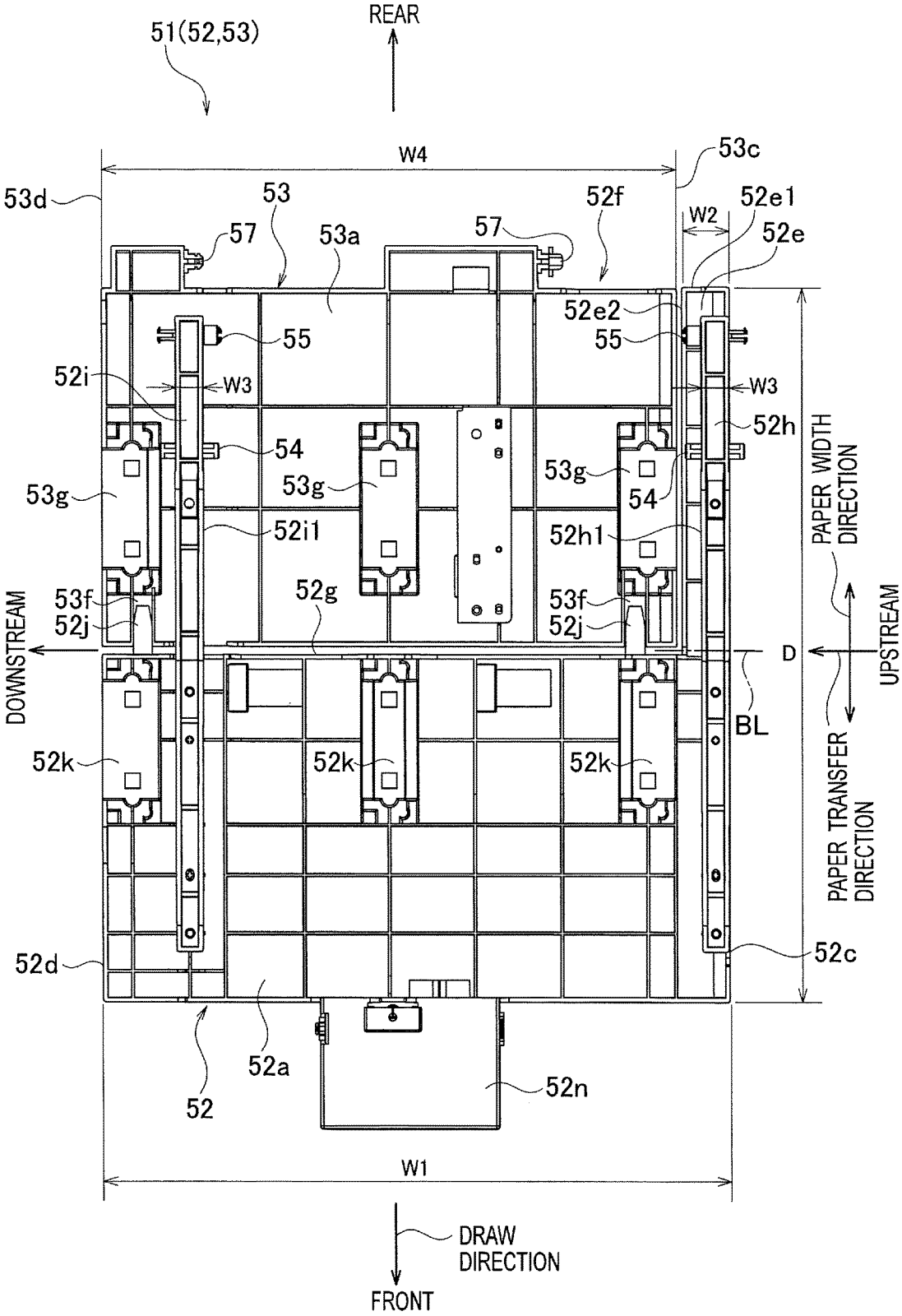
FIG. 5 is a plan view of the driven-side paper guide plate.

As shown in FIG. 4 and FIG. 5, each of the first divided paper guide plate 52 and the second divided paper guide plate 53 is made of resin as a frame body, and its rigidity is enhanced by forming plural reinforcing ribs on its upper surface 52*a*/53*a* in a grid manner. A bottom surface 52*b* of the first divided paper guide plate 52 and a bottom surface 53*b* (see FIG. 7) of the second divided paper guide plate 53 face to the upper surface 41*a* of the drive-side paper guide plate 41, and are made flat from their upstream-side portions to their downstream-side portions so as to correspond with the upper surface 41*a*.

Figures 6A, 6B:
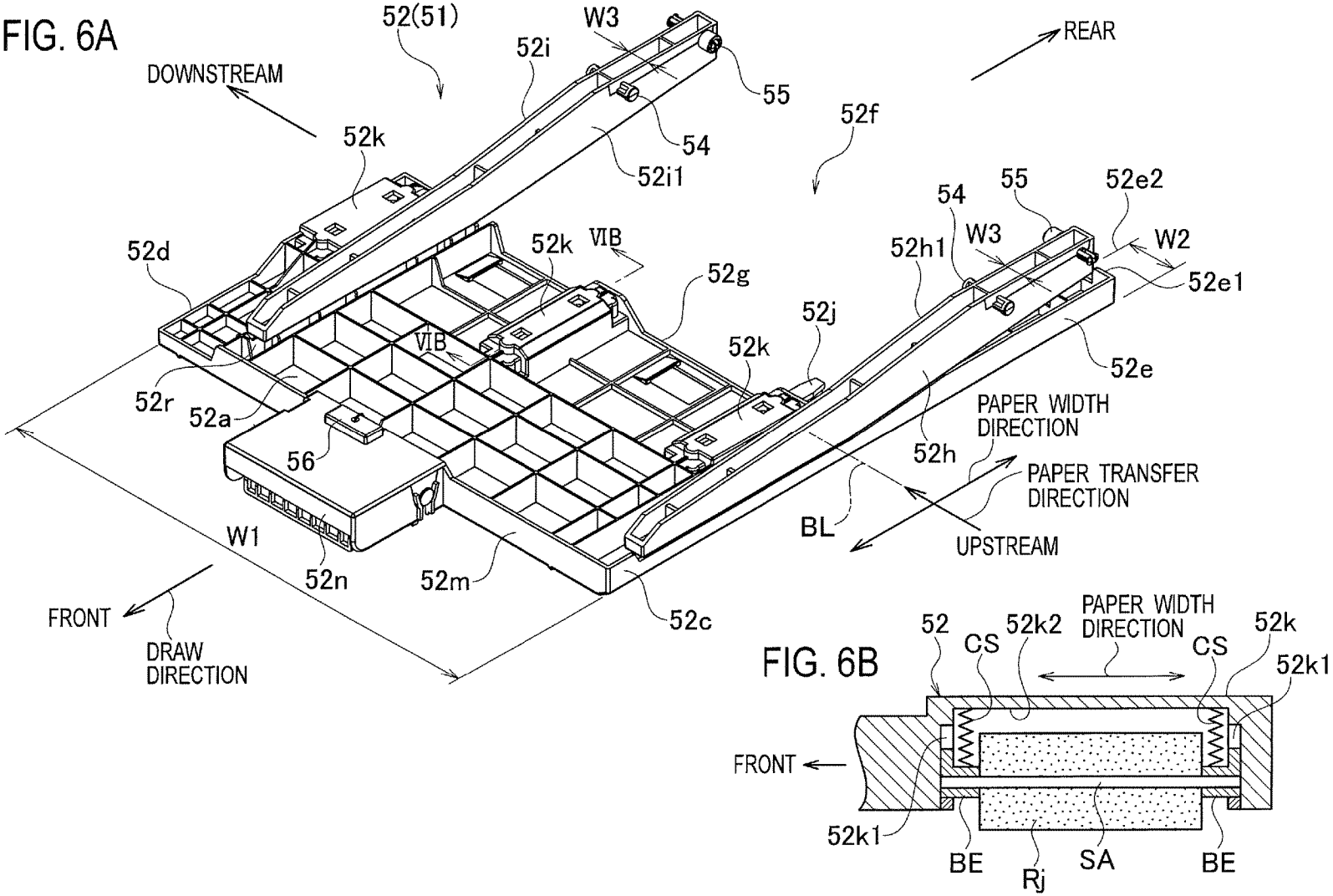
FIG. 6A is a perspective view of a first divided paper guide plate of the driven-side paper guide plate.
FIG. 6B is a cross-sectional view taken along a line VIB-VIB shown in FIG. 6A.

As shown in FIG. 5 and FIG. 6A, the first divided paper guide plate 52 (that is disposed above the drive-side paper guide plate 41 and on a front-side portion of the paper transfer device 30) has a lateral width W1, that is the same as the lateral width W1 of the drive-side paper guide plate 41, between its upstream-side outer side surface 52*c* and its downstream-side outer side surface 52*d*. The first divided paper guide plate 52 includes a wing portion 52*e* that has a narrow width W2 and is longitudinally protruded rearward from the dividing line BL along the upstream-side outer side surface 52*c*. The wing portion 52*e* has a function for guiding relay-transfer of a paper P sent from an upstream side while restricting the paper P between the wing portion 52*e* itself and the upper surface 41*a* of the drive-side paper guide plate 41.

The first divided paper guide plate 52 is provided with a rectangular accommodation portion 52*f* that accommodates the second divided paper guide plate 53. The rectangular accommodation portion 52*f* is formed by an inside rear surface 52*g* along the dividing line BL, an extension of an rear end surface 52*e*1 of the wing portion 52*e*, an inside surface 52*e*2 of the wing portion 52*e*, and an extension of the downstream-side outer side surface 52*d*. A width of the rectangular accommodation portion 52*f* along the paper transfer direction is made slightly larger than a lateral width W4 of the second divided paper guide plate 53.

The first divided paper guide plate 52 includes an upstream-side guide wing portion 52*h* that has a narrow width W3 and is longitudinally protruded rearward from the dividing line BL along the upstream-side outer side surface 52*c*. The guide wing portion 52*h* is disposed above the above-described wing portion 52*e* and adjacent to the wing portion 52*e*. The first divided paper guide plate 52 also includes a downstream-side guide wing portion 52*i* that has a narrow width W3 and is longitudinally protruded rearward from the dividing line BL along a reinforcing rib 52*r* formed on the upper surface 52*a* to extends over the rectangular accommodation portion 52*f*. The reinforcing rib 52*r* is formed at a slightly inner position from the downstream-side outer side surface 52*d*, and the guide wing portion 52*i* is disposed above the reinforcing rib 52*r* and adjacent to the reinforcing rib 52*r*. The guide wing portion 52*h* and the guide wing portion 52*i* are faced to each other, and extend parallel to each other along the paper width direction.

Each height level of the guide wing portions 52*h* and 52*i* is made gradually higher from the front side toward the rear side. The pair of guide wing portions 52*h* and 52*i* may be formed (molded) integrally with the first divided paper guide plate 52, or may be formed (molded) independently with the first divided paper guide plate 52 and then attached to the first divided paper guide plate 52 by use of screws. In addition, the small-diameter pin 54 and the large-diameter pin 55 are protruded inward from each rear-side portion of the guide wing portions 52*h* and 52*i*.

The first divided paper guide plate 52 is installed so that an inner surface 52*h*1 of the guide wing portion 52*h* faces to the draw-out guide plate 33 and an inner surface 52*i*1 of the guide wing portion 52*i* faces to the draw-out guide plate 34. In this state, the small-diameter pins 54 and the large-diameter pins 55 are slidably engaged with the guide slots 33*a* and 34*a*. Two press tabs 52*j* are formed on an upstream-side portion and a downstream-side portion of the inside rear surface 52*g* extending along the dividing line B so as to protrude into the rectangular accommodation portion 52*f* from the inside rear surface 52*g*. The press tabs 52*j* engage with depressed portion 53*f* (see FIG. 7) formed on a front end face 53*e* of the second divided paper guide plate 53 to be aligned with the depressed portion 53*f*, and thereby prevent a front end of the second divided paper guide plate 53 from lifting upward to contact the driven rollers Rj on the second divided paper guide plate 53 with the drive rollers Rk on the drive-side paper guide plate 41.

As shown in FIG. 6A, on the first divided paper guide plate 52, three box-shaped portions 52*k* are formed near the dividing line BL at an upstream-side portion, an almost middle portion and a downstream-side portion so that their tops are closed. As shown in FIG. 6B, in each of the box-shaped portions 52*k*, the driven roller Rj is accommodated so as to face to the drive roller Rk (see FIG. 3). In each of the box-shaped portions 52*k*, the driven roller Rj is fixed to a short roller shaft SA extending in the paper width direction, and bushes BE are attached to both ends of the roller shaft SA.

A recess 52*k*1 for holding the bush BE is formed at either side in each of the box-shaped portions 52*k*. The bush BE is loosely installed in the recess 52*k*1. A compressed spring CS is installed between an inner top surface 52*k*2 of the box-shaped portion 52*k* and the bush BE. While the first divided paper guide plate 52 is locked with the drive-side paper guide plate 41, the driven roller Rj is pressed onto the drive roller Rk with a paper P interposed therebetween. Therefore, the drive roller(s) Rk and the driven roller(s) Rj transfer a paper P in the paper transfer direction while they nip the paper P therebetween.

As shown in FIG. 6A, a handle 52*n* is formed at an almost center of a front end face 52*m* of the first divided paper guide plate 52 so as to protrude to the front side. When a user pulls the handle 52*n* to the front side, the first divided paper guide plate 52 is drawn out to the front side. A lock mechanism 56 is provided at a rear-side portion of the handle 52*n* so as to associate with the above-described lock mechanism 44 of the drive-side paper guide plate 41 (see FIG. 3).

Figure 7:
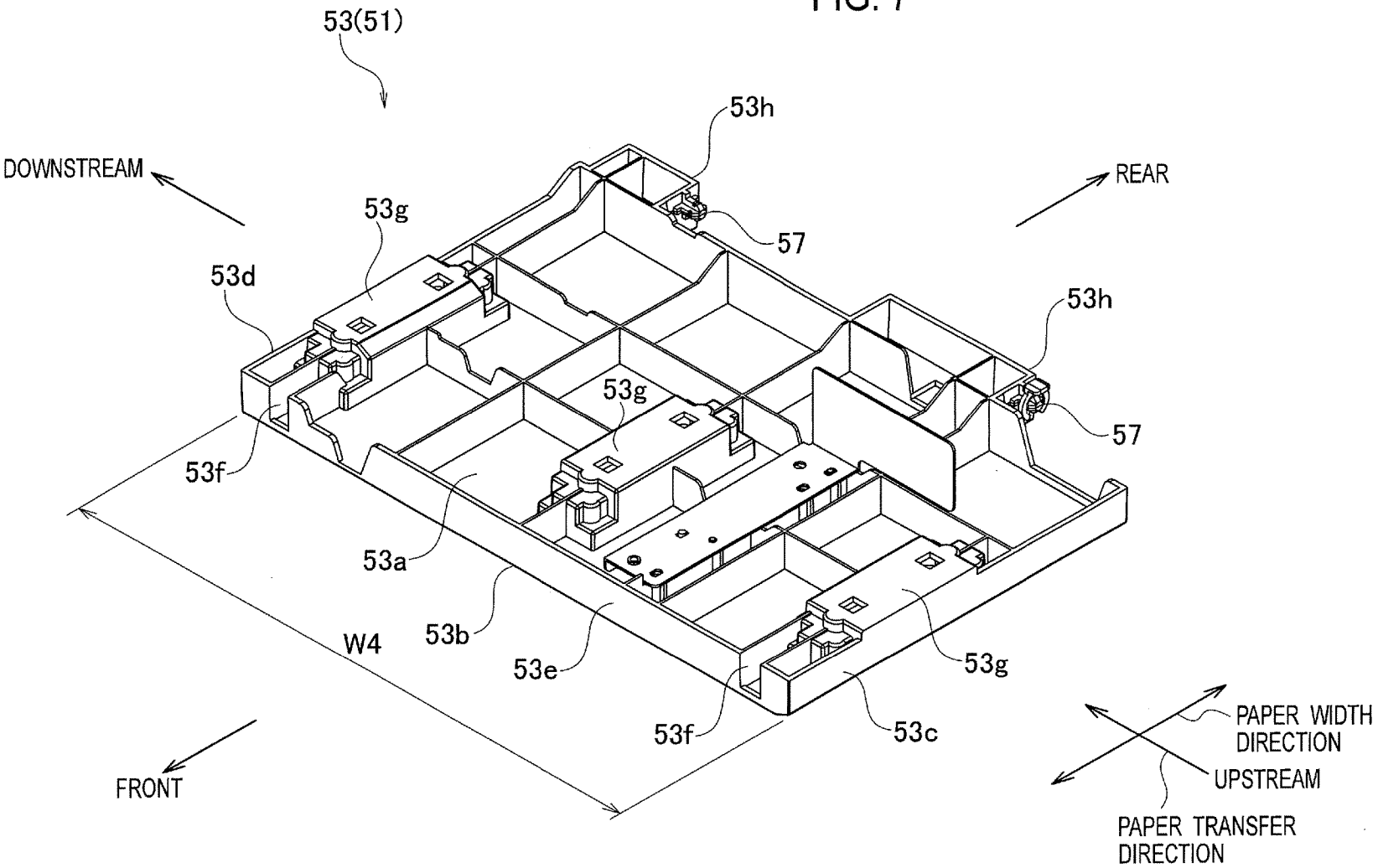
FIG. 7 is a perspective view of a second divided paper guide plate of the driven-side paper guide plate.

As shown in FIG. 5 and FIG. 7, the second divided paper guide plate 53 (that is disposed above the drive-side paper guide plate 41 and on a rear side of the paper transfer device 30) is accommodated in the rectangular accommodation portion 52*f* (see FIG. 5 and FIG. 6) as described above. Therefore, the second divided paper guide plate 53 is formed smaller than the first divided paper guide plate 52. The lateral width W4 of the second divided paper guide plate 53 between its upstream-side outer side surface 53*c* and its downstream-side outer side surface 53*d* is determined so that the second divided paper guide plate 53 can be accommodated in the rectangular accommodation portion 52*f*.

Two depressed portions 53*f* are formed on an upstream-side portion and a downstream-side portion on the front end face 53*e* of the second divided paper guide plate 53, respectively. The depressed portions 53*f* are formed so that their front ends and tops are opened. The depressed portions 53*f* engage with the above-described press tabs 52*j* of the first divided paper guide plate 52 to align the first divided paper guide plate 52 and the second divided guide plate 53. The front end of the second divided paper guide plate 53 is pressed toward the drive-side paper guide plate 41 (see FIG. 2 and FIG. 3) by the press tabs 52*j*.

Also on the second divided paper guide plate 53, three box-shaped portions 53*g* are formed near the dividing line BL at an upstream-side portion, an almost middle portion and a downstream-side portion so that their tops are closed. In each of the box-shaped portions 53*g*, the above-described driven roller Rj (see FIG. 6B) is accommodated. Two axis support portions 53*h* are formed on a rear end of the second divided paper guide plate 53 so as to be distanced from each other along the paper transfer direction. From the axis support portions 53*h*, axial protrusions 57 are protruded laterally toward an upstream of the paper transfer direction, respectively. The axial protrusions 57 are axially supported by brackets (not shown in the drawings) formed on a rear end of the drive-side paper guide plate 41, so that the second divided paper guide plate 53 can be opened upwardly (is rotatable).

Next, operations of the paper transfer device 30 will be described with reference to FIG. 8A and FIG. 8B. Following descriptions are made only with reference to the upstream-side draw-out guide plate 33 and the upstream-side guide wing portion 52*h*. Since the downstream-side draw-out guide plate 34 and the downstream-side guide wing portion 52*i* are operated symmetrically to the upstream-side draw-out guide plate 33 and the upstream-side guide wing portion 52*h*, descriptions about the downstream-side draw-out guide plate 34 and the downstream-side guide wing portion 52*i* are omitted.

Figure 8A:
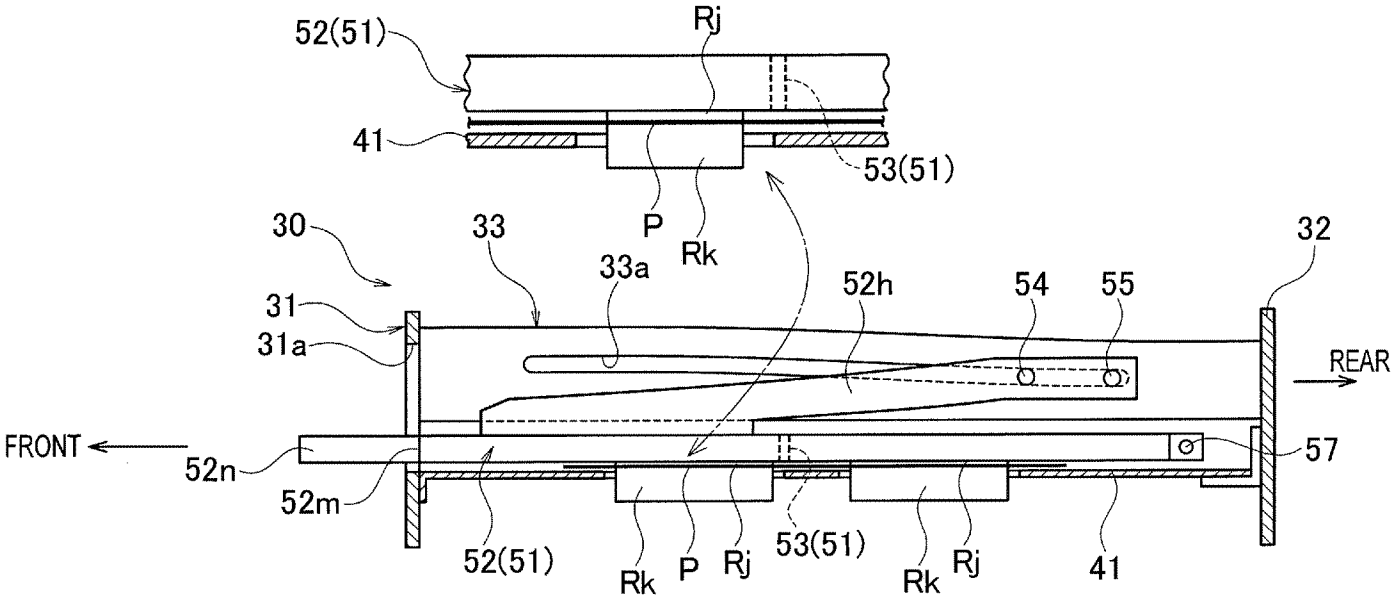
FIG. 8A is a cross-sectional side view of the paper transfer device (before drawing out the first divided paper guide plate)

As shown in FIG. 8A, in the paper transfer device 30, the first divided paper guide plate 52 and the second divided paper guide plate 53 of the driven-side paper guide plate 51 are accommodated above the drive-side paper guide plate 41. In a state where the draw-out guide plate 33 is attached to the front panel 31 and the rear panel 32, the first divided paper guide plate 52 is accommodated at a front-side portion of the paper transfer device 30 and the second divided paper guide plate 53 is accommodated at a rear-side portion of the paper transfer device 30 so that they face to the drive-side paper guide plate 41.

Here, the small-diameter pin 54 and the large-diameter pin 55 protruded from the guide wing portion 52*h* are engaged with a rear-side portion in the guide slot 33*a* of the draw-out guide plate 33 that is located at a low position. Therefore, the first divided paper guide plate is located at its accommodation position lower than its after-described draw-out completion position. In addition, the handle 52*n* formed on the front end face 52*m* of the first divided paper guide plate 52 is protruded to the front side from the rectangular hole 31*a* opened on the front panel 31.

The lock mechanism 56 (see FIG. 6) provided at the rear-side portion of the handle 52*n* is locked with the lock mechanism 44 (see FIG. 3) provided at the front end of the drive-side paper guide plate 41. Therefore, while the first divided paper guide plate 52 is being locked, a paper(s) P is nipped between the drive rollers Rk and the driven rollers Rj, and transferred by the drive rollers Rk and the driven rollers Rj.

Figure 8B:
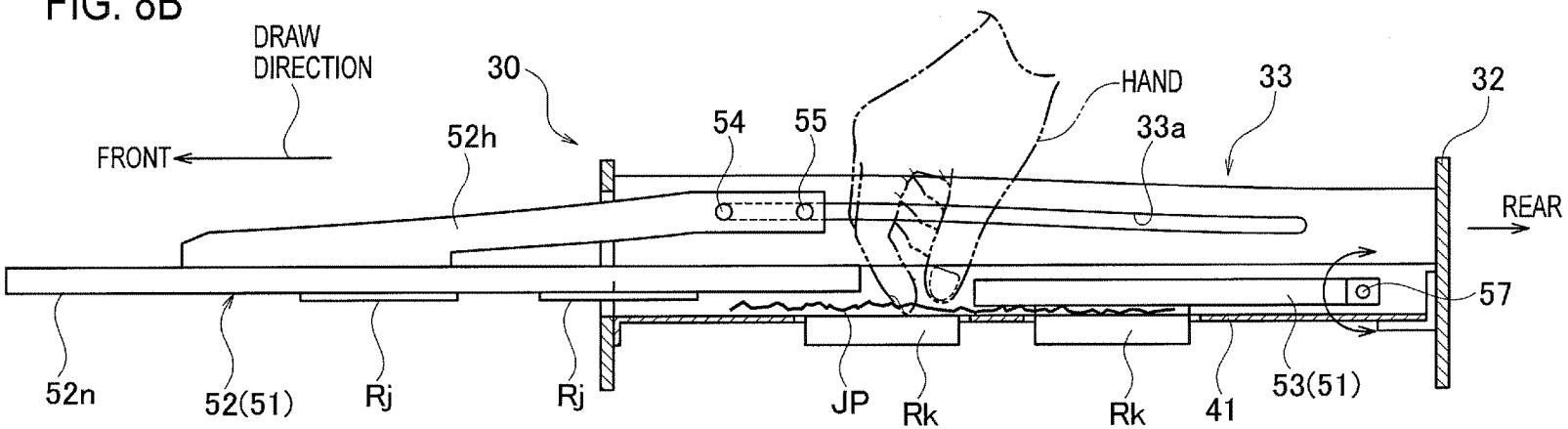
FIG. 8B is a cross-sectional side view of the paper transfer device (after drawing out the first divided paper guide plate)

Here, if a paper P jams between the drive-side paper guide plate 41 and the driven-side paper guide plate 51, a user unlocks the first divided paper guide plate 52 (the lock mechanism 56) from the drive-side paper guide plate 41 (the lock mechanism 44), and then draws out the first divided paper guide plate 52 to the front side as shown in FIG. 8B. Along with the draw-out operation of the first divided paper guide plate 52, the small-diameter pin 54 and the large-diameter pin 55 move to a front-side portion in the guide slot 33*a* that is located at a high position. Therefore, the first divided paper guide plate 52 is located at the draw-out completion position higher than the above-described accommodation position.

The driven rollers Rj on the first divided paper guide plate 52 are separated from the drive rollers Rk on the drive-side paper guide plate 41 along with the draw-out operation, and thereby a jammed paper JP is made free due to releases of nips between the driven rollers Rj on the first divided paper guide plate 52 and the drive rollers Rk associated with them. Therefore, a user can remove the jammed paper P by inserting his/her hand over the front panel 31. Here, since the second divided paper guide plate 53 is not pressed downward by the press tabs 52*j*, the nips between the driven rollers Rj and the drive rollers Rk are released (i.e. the removal of the jammed paper JP is not inhibited). In addition, since the second divided paper guide plate 53 can be opened upward (rotatable about the axial protrusions 57), a user can open the second divided paper guide plate 53, if needed, in order to remove the jammed paper JP more easily. When the second divided paper guide plate 53 is opened, the nips between the driven rollers Rj and the drive rollers Rk are released completely.

Next, a reason why the pair of draw-out guide plates 33 and 34 is attached to the front panel 31 and the rear panel 32 will be explained with reference to FIG. 9.

Figure 9:
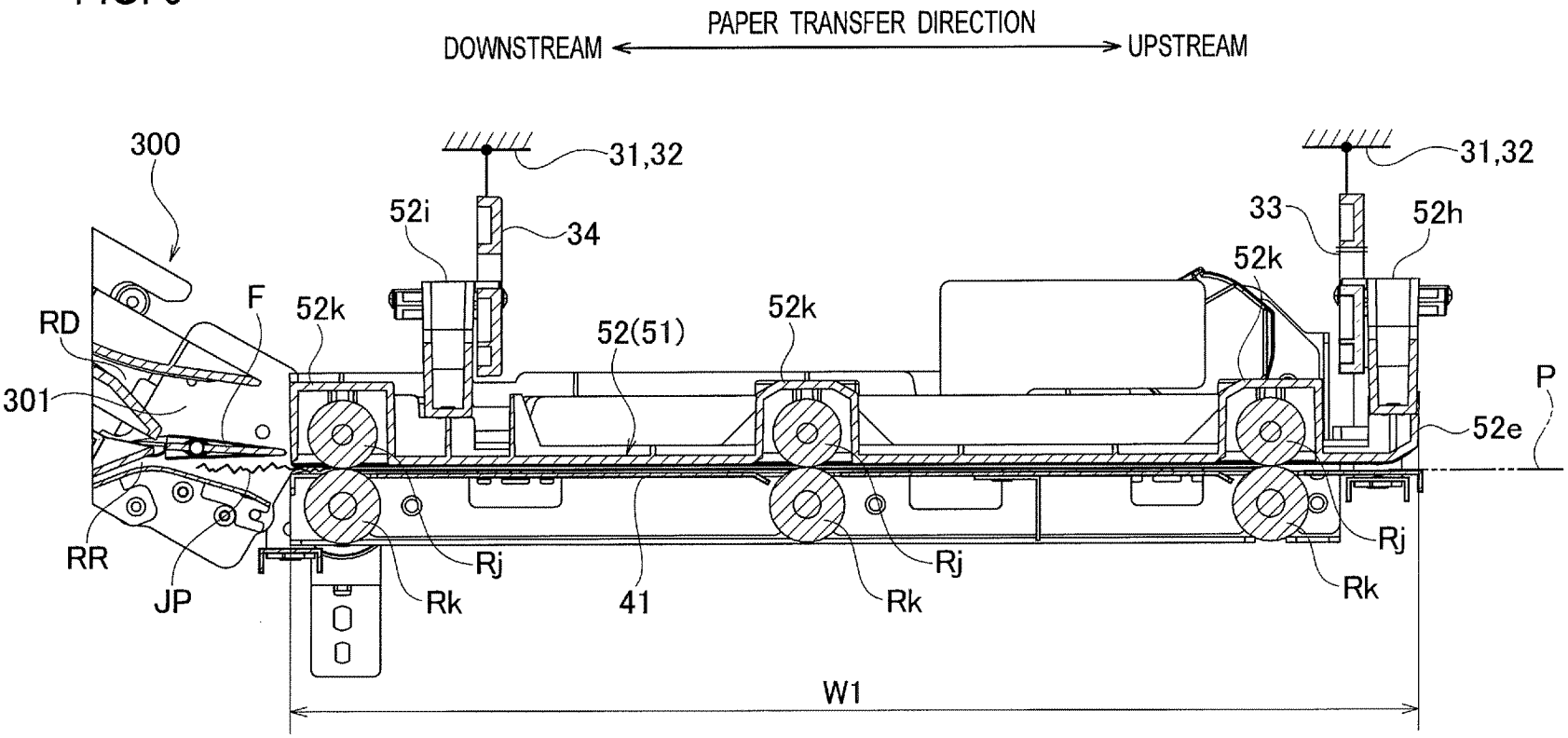
FIG. 9 is a cross-sectional front view of the paper transfer device.

As shown in FIG. 9, the paper transfer device 30 is disposed between neighboring two paper transfer devices that are located upstream and downstream sides of the paper transfer device 30 in the paper transfer direction, respectively. One of the neighboring two paper transfer devices that is disposed on the downstream side is another paper transfer device 300. Another of the neighboring two paper transfer devices that is disposed on the upstream side is not shown in FIG. 9.

A swingable flap F that changes the paper transfer direction of a paper P is provided on a paper transfer path 301 in the other paper transfer device 300. The paper transfer path 301 can be changed over selectively by the flap F so as to lead a paper P to the paper ejection path RD or the switchback path RR. The paper transfer path 301 corresponds with the paper transfer path 12 (the paper ejection path RD or the switchback path RR) in the inkjet printer 10 shown in FIG. 1.

In the paper transfer device 30, the pair of draw-out guide plates 33 and 34 for guiding the first divided paper guide plate 52 is attached to the front panel 31 and the rear panel 32 above the first divided paper guide plate 52 (located at its accommodation position) so as to be distanced from the drive-side paper guide plate 41 and the driven-side paper guide plate 51. Therefore, the width W1 of the first divided paper guide plate 52 along the paper transfer direction can be made larger than the width of the driven-side paper guide plate 221 of the imaginary paper transfer device 200 that might be made by applying the prior-art mechanism disclosed in the Patent Document 1 and was already explained with reference to FIG. 11.

Therefore, the first divided paper guide plate 52 can be drawn out to the front side along its entire width W1 equivalent to the width W1 of the drive-side paper guide plate 41. Therefore, the wing portion 52*e* that is provided on the first divided paper guide plate 52 for guiding relay-transfer of a paper P sent from the upstream-side paper transfer device can be drawn out integrally with the first divided paper guide plate 52.

In addition, the driven roller Rj provided on a further downstream side from the downstream-side draw-out guide plate 34 can be also draw out integrally with the first divided paper guide plate 52. The driven roller Rj is the above-mentioned transfer relay member for guiding relay-transfer of a paper P between the paper transfer device 30 and the other paper transfer device 300.

As described above, the draw-out completion position of the first divided paper guide plate 52 is higher than the accommodation position thereof. Therefore, differently from the imaginary paper transfer device 200 shown in FIG. 11, even when a paper P sent from an upstream side jams between the drive-side paper guide plate 41 and the wing portion 52*e*, the wing portion 52*e* is distanced from the drive-side paper guide plate 41 along with the draw-out operation of the first divided paper guide plate 52. Therefore, a jammed paper extending from the upstream-side paper transfer device to the paper transfer device 30 can be removed easily and surely, and thereby transfer performance of a paper(s) P can be maintained.

On the other hand, differently from the imaginary paper transfer device 200 shown in FIG. 11, even when a paper P jams between the driven roller Rj disposed on a downstream side from the downstream-side draw-out guide plate 34 and the driven roller Rk associated with the driven roller Rj, the driven roller Rj is separated from the drive roller Rk (a nip between them is released) along with the draw-out operation of the first divided paper guide plate 52. Therefore, a jammed paper JP extending from the paper transfer device 30 to the downstream-side other paper transfer device 300 can be removed easily and surely, and thereby transfer performance of a paper(s) P can be maintained.

Namely, it is not needed to provide the transfer relay member (for guiding relay-transfer of a paper P between the paper transfer device 30 and the other paper transfer device 300: i.e. the driven roller Rj) fixedly on the paper transfer direction. As a result, it is possible to remove a jammed paper JP extending from the paper transfer device 30 to the other paper transfer device 300 easily and surely while preventing a size of the paper transfer device 30 from being large along the paper transfer direction.

In addition, since the drive-side paper guide plate 41 and the pair of draw-out guide plates 33 and 34 are fixedly supported by the front panel 31 and the rear panel 32 of the paper transfer device 30, it becomes possible to simplify attachment structures of the drive-side paper guide plate 41 and the pair of draw-out guide plates 33 and 34.

Note that, in the above embodiment, the driven-side paper guide plate (the first paper guide plate) 51 that faces to the drive-side paper guide plate (the second paper guide plate) 41 is divided into two parts, i.e. the first divided paper guide plate 52 and the second divided paper guide plate 53, along the paper width direction. Therefore, it becomes possible to reduce an area occupied by the drawn-out first divided paper guide plate 52. However, the present invention is not limited to this configuration. For example, the driven-side paper guide plate (the first paper guide plate) 51 may be integrally formed to have functions of the first divided paper guide plate 52 and the second divided paper guide plate 53 without being divided into two parts along the paper width direction separately/independently from each other.

In the above embodiment, the draw-out guide plates 33 and 34 engage with the pins 54 and 55 (see FIG. 6A), and the nips between the driven rollers Rj and the drive rollers Rk are released along with the draw-out operation of the first divided paper guide plate 52. However, slide members slidable along the draw-out guide plates 33 and 34 may be provided instead of the pins 54 and 55.

Further, the draw-out guide plates 33 and 34 are not be necessarily provided in a pair (as two parts), but may be provided as a single part (may be integrated into a single part) disposed near the center of the driven-side paper guide plate 51 along the paper transfer direction.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims benefit of priority under 35 U.S.C. §119 to Japanese Patent Application No. 2015-105476, filed on May 25, 2015, which is incorporated herein by reference.

What is claimed is:

1. A paper transfer device that transfers a paper along a paper transfer path, the device comprising:

a first paper guide plate that includes a transfer roller for transferring the paper in a paper transfer direction to guide one face of the paper while transferring the paper;

a second paper guide plate that is divided into a front-side guide plate and a rear-side guide plate, the front-side guide plate being able to be drawn out in a draw-out direction perpendicular to the paper transfer direction while facing to the first paper guide plate, and the second paper guide plate includes a driven roller driven while facing to the first paper guide plate and pressing the transfer roller with the paper interposed therebetween to guide another face of the paper while transferring the paper;

a front panel and a rear panel spaced from the front panel, the front panel and the rear panel extend parallel to the paper transfer direction, and the first paper guide plate has a first end that is attached to the front panel and a second end that is attached to the rear panel; and a draw-out guide member that is provided above the second paper guide plate, and formed so as to release a nip between the transfer roller and the driven roller by separating the driven roller from the transfer roller when the front-side guide plate is drawn out in the draw-out direction in an engaged state where the draw-out guide member is engaged with an engagement portion provided on the second paper guide plate, and the draw-out guide member is attached at a first end thereof to the front panel and is attached at a second end thereof to the rear panel; wherein a dividing line of the front-side guide plate and the rear-side guide plate extends in the paper transfer direction and is disposed at almost a center of the second paper guide plate in the draw-out direction.

* * * * *